US006324372B1

(12) United States Patent
Hirota

(10) Patent No.: US 6,324,372 B1
(45) Date of Patent: Nov. 27, 2001

(54) MAGNET ROLLER, PROCESS FOR PRODUCING SAME AND DEVELOPING UNIT USING SAME

(75) Inventor: Kazunori Hirota, Kanagawa-ken (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/556,591

(22) Filed: Apr. 20, 2000

(30) Foreign Application Priority Data

Apr. 27, 1999 (JP) ..... 11-119908

(51) Int. Cl.[7] ..... G03G 15/09
(52) U.S. Cl. ..... 399/277
(58) Field of Search ..... 399/277, 267, 399/279, 286; 492/8, 18; 428/36.8, 36.92; 29/895

(56) References Cited

U.S. PATENT DOCUMENTS 5,570,167 * 10/1996 Kuroda ..... 399/267
5,583,473 * 12/1996 Yamashita ..... 399/267 X
5,740,509 * 4/1998 Hibi et al. ..... 399/277
5,946,535 * 8/1999 Aoki ..... 399/277
6,125,255 * 9/2000 Litman et al. ..... 399/277
6,132,634 * 10/2000 Nishimuro et al. ..... 492/8

FOREIGN PATENT DOCUMENTS 08-162319 * 6/1996 (JP) .
08-162320 * 6/1996 (JP) .

* cited by examiner

*Primary Examiner*—Arthur T. Grimley
*Assistant Examiner*—Hoan Tran
(74) *Attorney, Agent, or Firm*—Oblon, Spivak, McClelland, Maier & Neustadt, P.C.

(57) ABSTRACT

There are disclosed a magnet roller which includes a magnet main body portion and a shaft portion, wherein the magnet main body portion includes a composition for magnets and has at least one hollow portion in the inside thereof; a process for producing a magnet roller having a magnet main body portion and a shaft portion, which includes arranging in advance, at least one member for forming a hollow portion in a cavity of a mold which has generated a magnetic field on the circumference of the cavity, pouring a composition for magnets into the mold, and thereafter withdrawing the member for forming the hollow portion so that at least one hollow portion is formed in the inside of the magnet roller; and a developing unit which includes a developing roller constituted of a sleeve installed in a freely rotatable manner and the above magnet roller installed inside the sleeve. The magnet roller can be produced at a low cost owing to curtailed use quantity of a composition for magnets, can suppress the lowering of magnetic force due to voids on the outside periphery thereof, and is favorably employed, for instance, in image forming equipment such as copying machinery, printers and facsimile machinery.

11 Claims, 1 Drawing Sheet

MAGNET ROLLER, PROCESS FOR PRODUCING SAME AND DEVELOPING UNIT USING SAME

BACKGROUND OF THE INVENTION

1. Field of the Invention

The present invention relates to a magnet roller, a process for producing the magnet roller and a developing unit using the magnet roller. More particularly, the present invention is concerned with a magnet roller which is lowered in production cost by a curtailment of the amount of a composition for magnets to be used, is suppressed in lowering of magnetic force due to voids, and is well suited for use in a developing mechanism portion and the like in image formation apparatuses; a process for efficiently producing the aforesaid magnet roller; and a developing unit equipped with said magnet roller.

2. Description of the Related Arts

There is known, in the field of electrophographic equipment and electrostatic recording equipment such as copying machinery and printers, a method for visualizing an electrostatic latent image by locating a magnet roller which is formed with a composition for a magnet in a rotating sleeve as a developing roller for the purpose of visualizing an electrostatic latent image on a latent image holding body such as a photosensitive drum and by supplying the surface of the latent image holding body with a magnetic developer (toner) through a so-called jumping phenomenon that allows the toner which is held on the surface of the sleeve to jump over onto the latent image holding body by means of the magnetic characteristics of said magnet roller.

The above-mentioned magnet roller is constituted of a shaft portion and a magnet main body portion composed of a composition for magnets. The types of said magnet rollers include, for instance, (1) integrated shaft type in which the magnet main body portion and the shaft portion are integrally molded with a composition for magnets; (2) one side inserted shaft type in which the magnet main body portion and the shaft portion on one side are integrally molded with a composition for magnets and a shaft is inserted on the other side; (3) both sides inserted shaft type in which the magnet main body portion is molded with a composition for magnets and shafts are respectively inserted on both the sides;and (4) penetrated shaft type in which the magnet main body portion is molded with a composition for magnets and a shaft is penetrated therethrough.

In regard to a process for producing such a magnet roller, there is prevailingly employed a process which comprises molding a magnet main body portion by injection molding or extrusion molding of a composition for magnets in which magnetic powders are mixed with a thermoplastic resin binder composed principally of nylon or polypropylene, by the use of a mold which has generated a magnetic field on the circumference of a cavity thereof to mold the composition into the form of a roller and magnetize to desired magnetic force characteristics.

The process for forming a magnet main body portion by injection molding or extrusion molding by means of a mold in the above-mentioned manner, is involved in such problems that since the magnet main body portion to be obtained is compacted with a composition for magnets, the amount of said composition to be used is unfavorably increased, thus causing inevitably high cost of said main body and besides, the vicinity of the outside periphery thereof is usually liable to contain unfavorable voids, thereby often resulting in deteriorated magnetic force.

SUMMARY OF THE INVENTION

In such circumstances, a general object of the present invention is to provide a magnet roller which is lowered in production cost by a curtailment of the amount of a composition for magnets to be used, is suppressed in lowering of magnetic force due to voids, and is well suited for use in a developing mechanism portion and the like in image formation apparatuses; a process for efficiently producing the aforesaid magnet roller; and a developing unit equipped with said magnet roller.

Other objects of the present invention will be obvious from the text of this specification hereinafter disclosed.

In order to attain the above-mentioned object, intensive extensive research and investigation were accumulated by the present inventors. As a result, it has been found that said objects can be achieved by a magnet roller wherein a magnet main body portion has at least one hollow portion in the inside thereof and in particular, voids are substantially absent in the vicinity of the outside periphery of said magnet main body portion, but are present on the periphery of said hollow portion.

It has also been found that the above-mentioned magnet roller can easily be produced by arranging in advance, at least one member for forming the hollow portion in a cavity of a mold which has generated a magnetic field on the circumference of a cavity thereof, pouring a composition for resin magnets into said mold, and thereafter withdrawing said member for forming said hollow portion. In addition, by paying attention to the fact that voids are more apt to be generated on higher temperature side of the magnet main body portion, it has also been found that voids are caused to be substantially absent in the vicinity of the outside periphery of said magnet main body portion, but to be present on the periphery of said hollow portion by causing the temperature of said member for forming the hollow portion to be higher than the temperature of the wall surface of the mold. The present invention has been accomplished by the foregoing findings and information.

Specifically the present invention provides:

(1) a magnet roller which comprises a magnet main body portion and a shaft portion, wherein said magnet main body portion comprises a composition for magnets and has at least one hollow portion in the inside thereof;

(2) the magnet roller as set forth in item (1), wherein voids are substantially absent in the vicinity of the outside periphery of said magnet main body portion, but are present on the periphery of said hollow portion;

(3) a process for producing a magnetic member comprising a magnet main body portion and a shaft portion, which comprises arranging in advance, at least one member for forming a hollow portion in a cavity of a mold which has generated a magnetic field on the circumference of a cavity thereof, pouring a composition for resin magnets into said mold, and thereafter withdrawing said member for forming said hollow portion so as to form at least one hollow portion in the inside of said magnetic member;

(4) the process for producing a magnetic member as set forth in item (3), wherein a heat conductive material is used as the member for forming a hollow portion, the temperature of said member is kept higher than the temperature of the wall surface of the mold, and the the composition for resin magnets is poured into said mold;

(5) a developing unit which comprises a developing roller constituted of a sleeve installed in a freely rotatable manner and a magnet roller installed inside said sleeve; preserves a magnetic developer on the surface of said sleeve by the magnetic characteristics of said magnet roller; forms a thin layer having a prescribed thickness from said magnetic developer by means of a layer forming blade; allows the magnet roller to contact or approach the surface of an image forming body in the above-mentioned state so as to feed said magnetic developer from the sleeve to the surface of the image forming body by the magnetic characteristics of said magnet roller; and thus forms a visible image on the surface of said image forming body, characterized in that the magnet roller in any of the items (1) and (2) is brought into use.

DESCRIPTION OF SYMBOLS

1: magnet main body portion

2*a*: shaft portion

2*b*: shaft

3: hollow portion

DESCRIPTION OF THE PREFERRED EMBODIMENTS

Figure 1A:
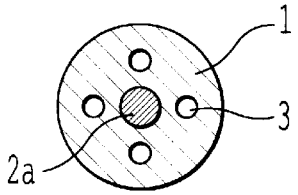
FIGS. 1(*a*) and 1(*b*) include an elevational view (a) and a side view (b) showing one example of the magnet roller according to the present invention.

The magnet roller according to the present invention is constituted of a magnet main body portion comprising a composition for magnets, and of a shaft portion, wherein the magnet main body portion has at least one hollow portion inside.

The shape, size, positions and the number of the hollow portions are not specifically limited, but need to be properly selected to the extent that the mechanical strength of the magnet roller is preserved. The total volume of the hollow portions is preferably in the range of 8.2 to 21% based on the volume of the magnet main body portion. Said total volume, when being less than 8.2% based thereon, results in failure to sufficiently exhibit an effect on cost curtailment, whereas said total volume, when being more than 21% based thereon, leads to a fear of causing too low mechanical strength of the magnet roller to be practical, Taking into consideration both the effect on cost curtailment and mechanical strength thereof the total volume of the hollow portions is particularly preferably in the range of 11.8 to 18.5% based thereon.

In the magnet roller according to the present invention, it is preferable that voids be substantially absent in the vicinity of the outside periphery of said magnet main body portion, but be present on the periphery of said hollow portions. The voids, which are more apt to generate on a higher temperature side at the time of molding with a mold, usually generate in the vicinity of the outside periphery of the magnet main body portion. In the just mentioned case, the magnetic force of the magnet roller is inevitably lowered. Notwithstanding the foregoing, the magnetic force thereof is prevented from lowering when the voids are present inside instead of outside periphery, as is the case with preferable embodiments of the present invention.

The magnet roller according to the present invention is usually obtained by molding a composition for magnets by the use of a mold which has generated a magnetic field on the circumference of a cavity thereof. There is preferably usable, as the above-mentioned composition for magnets, the mixture obtained by dispersing and mixing magnetic powders in at least one binder selected from the group consisting of resins and rubbery elastomers.

Said binder to be used in the composition for magnets is not specifically limited, but may be optionally selected for use from the binders that have heretofore been customarily employed for magnet rollers. Examples of resin binders include polyamide resin such as nylon 6 and nylon 12, polystyrene resin, polyethylene terephthalate resin (PET), polybutylene terephthalate resin (PBT), polyphenylene sulfide resin (PPS), ethylene/vinyl acetate copolymer resin (EVA), ethylene/ethyl acrylate copolymer resin (EEA), epoxy resin, ethylene/vinyl alcohol copolymer resin (EVOH), polyolefin such as polypropylene resin, polyethylene and polyethylene copolymer, modified polyolefin obtained by introducing, into the structure of the polyolefin, a reactive functional group such as maleic anhydride, carboxyl group, hydroxyl group and glycidyl group. Of these, polyamide resin, EVA and EEA are particularly preferable. Examples of the rubbery elastomer binders include nitrile rubber (NBR), chloroprene rubber(CR), chlorosulfonated polyethylene (CSM) and silicone rubber. Any of the above-exemplified resin binders and rubbery elastomer binders may be used alone or in combination with at least one other.

As the magnetic powders to be mixed with and dispersed in the aforesaid binders, there are usable optional magnetic powders which have heretofore been customarily used in magnet rollers. Specific examples thereof include ferrites such as strontium ferrite, barium ferrite and lead ferrite and powders of rare earth element series alloy such as Sm—Co alloy, Nd—Fe—B alloy and Ce—Co alloy. Any of the magnetic powders may be used alone or in combination with at least one other.

The blending ratio of the aforesaid magnetic powders in the composition for resin magnets is not specifically limited, but is properly selected in accordance with the intensity of magnetic force required of the magnetic roller, and is usually selected preferably in the range of 80 to 97% by weight (approximately 3.0 to 4.0 g/cm$^3$ in terms of density).

The composition for resin magnets according to the present invention may be blended with reinforcing fillers having high reinforcing effect exemplified by mica, whisker, talc and fibers such as carbon fibers and glass fibers. In the case of relatively weak magnetic force required for a molded article and a relatively small filling amount of magnetic powders, the molded article is prone to be low in rigidity. In order to compensate for low rigidity, the molded article can be reinforced by adding a filler such as mica and whisker. The preferably usable fillers are exemplified by mica and whisker. Examples of the whisker include non-oxide base whisker composed of silicon carbide, silicon nitride and the like, metal oxide base whisker composed of ZnO, MgO, $TiO_2$, $SnO_2$, $Al_2O_3$ and the like, double oxide base whisker composed of potassium titanate, aluminum borate, basic magnesium sulfate and the like. Of these, double oxide base whisker is preferable from the aspect of easiness of preparing composite products with a plastic.

The blending ratio of said filler is not specifically limited, but is usually in the range of 2 to 32% by weight, preferably 5 to 20% by weight based on the total amount of the composition for resin magnets.

There is no specific limitation on the process for preparing the composition for resin magnets. Said composition can be prepared, for instance, by mixing the binder, magnetic powders and at need, the filler according to a conventional method, melt kneading the resultant mixture, and thereafter molding the same into pellets. In this case, a conventional method and condition may be adopted, for instance, the melt kneading step can be carried out by the use of a twin screw extruder, a KCK kneading extruder or the like.

Figure 1B:
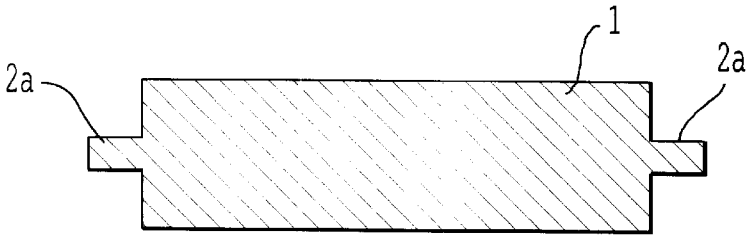
Figure 2A:
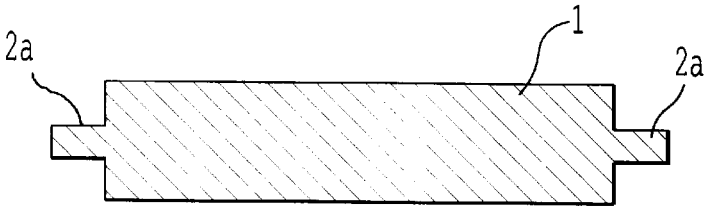
FIGS. 2(*a*) to 2(*d*) include side views showing different structures of the magnet rollers according to the present invention.
Figure 2B:
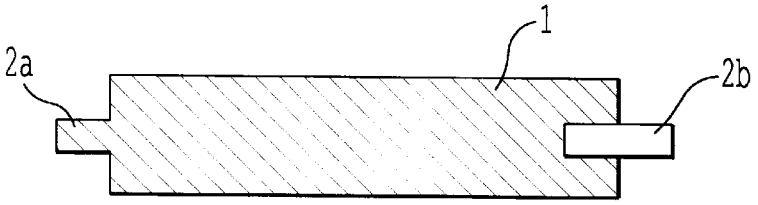
Figure 2C:
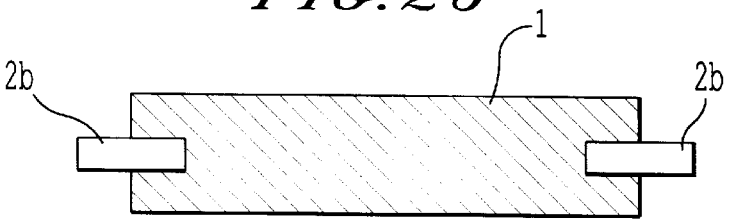
Figure 2D:
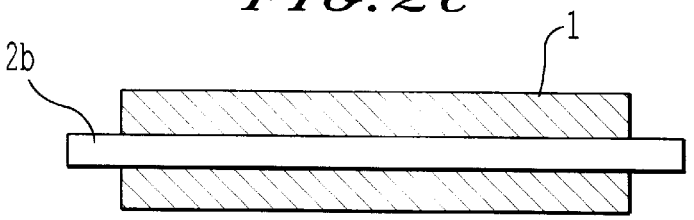

FIG. 1 includes an elevational view (a) and a side view(b) showing one example of the magnet roller according to the present invention. The magnet roller as illustrated in FIG. 1 is of the integrated shaft structure in which a magnet main body portion 1 and a shaft portion 2*a* are integrally formed with a composition for magnets, and four symmetrically placed hollow portions penetrate through the portion 1 in parallel to the center shaft.

The magnet roller according to the present invention can efficiently be produced by the process as described hereunder.

In the process for producing a magnetic roller according to the present invention, at least one member for forming a hollow portion is arranged in advance, in a cavity of a mold which has generated a magnetic field on the circumference of a cavity thereof. Thereafter, the composition for resin magnets is poured and molded into said mold by means of injection molding or extrusion molding. Thereafter said member for forming the hollow portion is withdrawn so as to form a magnet main body portion having at least one hollow portion in the inside of said main body. It is preferable in the case molding by pouring the composition for resin magnets to use a heat conductive material as a member for forming a hollow portion so as to keep the temperature of said member higher than the temperature of the wall surface of the mold. By the aforesaid procedure, voids are substantially absent in the vicinity of the outside periphery of said magnet main body portion, but are present on the periphery of said hollow portion, whereby the magnetic force can be prevented from being lowered.

FIG. 2 includes side views showing different structures of the magnet rollers that are produced according to the present invention. In FIG. 2, (a) denotes the structure of integrated shaft type in which the magnet main body portion 1 and the shaft portion 2*a* are integrally molded with a composition for magnets; (b) stands for the structure of one side inserted shaft type in which the magnet main body portion 1 and the shaft portion 2*a* on one side are integrally molded with a composition for magnets and a shaft 2*b* is inserted on the other side; (c) indicates the structure of both sides inserted shaft type in which the magnet main body portion 1 is molded with a composition for magnets and shafts 2*b*, 2*b* are respectively inserted on both the sides; and (d) represents the structure of penetrating shaft type in which the magnet main body portion 1 is molded with a composition for magnets and a shaft 2*b* is penetrated therethrough.

With regard to the magnet roller as illustrated in FIGS. 2(*a*) to (*d*), the shaft which is used as an inserting member is not specifically limited, but may be selected for use from the shafts which have heretofore been customarily used. Examples thereof include a solid or hollow shaft made of a metal and a shaft made of any of various resins.

The magnet roller thus obtained is usually demagnetized once, and then again magnetized to orientate the magnetic powders and to form a desired magnetic force pattern. The procedures of demagnetization and magnetization are not specifically limited, but may be put into practice according to the purpose of use by using a well known installation and method.

The magnet roller according to the present invention is favorably employed as the magnet roller which constitutes a developing roller and cleaning roller in electrophographic equipment and electrostatic recording equipment such as copying machinery, printers and facsimile machinery. The above mentioned cleaning roller is used to scrape away a toner remaining on an image retaining body such as a photosensitive drum and the like by means of a cleaning blade and thereafter recover the toner by the magnetic force. The magnet roller according to the present invention is placed at a place which is suitable for toner recovery so that it adsorbs the toner by the magnetic force, separates the adsorbed toner therefrom by the magnetic force at a prescribed position, and recovers said toner at a prescribed portion.

The developing unit according to the present invention is equipped with a developing roller constituted of a sleeve installed in a freely rotatable manner (usually cylindrical) and a magnet roller which is installed inside said sleeve, and has the above-mentioned desired magnetic pattern; supports a magnetic developer on the surface of said sleeve by the magnetic characteristics of said magnet roller; forms a thin layer having a prescribed thickness from said magnetic developer by means of a layer forming blade; allows the magnetic roller to contact or approach the surface of an image forming body in the above-mentioned state so as to feed said magnetic developer from the sleeve to the surface of the image forming body by the magnetic characteristics of said magnet roller; and thus forms a visible image on the surface of said image forming body.

In summarizing the working effects and advantages of the present invention, the above-described magnet roller exhibits such working effects that the manufacturing cost is reduced by the curtailment of the amount of the composition for magnets and besides, a decrease in magnetic force due to voids are favorably suppressed.

The magnet roller is favorably employed in developing mechanism portions which feed a developing agent to latent image retaining body such as a photosensitive drum, and develop electrostatic latent image on said latent image retaining body in the field of image forming equipment such as copying machinery, printers and facsimile machinery.

In the following, the present invention will be described in further detail with reference to comparative examples and working examples, which however shall never limit the present invention thereto.

EXAMPLE 1

Four stainless steel-made round bars each having a diameter of 3 mm as a member for forming hollow portions were placed at a prescribed position in the cavity of a mold which has generated a magnetic field on the circumference of the cavity thereof. Subsequently there was injection molded the composition for magnets which was composed by blending of 10% by weight of ethylene/ethyl acrylate copolymer as the binder and 90% by weight of strontium ferrite powders as the magnetic powders under the conditions including a cylinder temperature of 245° C., mold temperature of 65° C., temperature of the stainless steel-made round bars of 100° C., and an injection molding pressure of 700 kg/cm$^2$. Thereafter the four stainless steel-made round bars were withdrawn from the mold, and thus there was produced the integrated shaft type magnet roller as illustrated in FIG. 1 composed of a magnet main body portion which had 4 hollow portions, a diameter of 16 mm and a length of 310 mm, and a shaft portion which protruded from both the ends of said roller and had a diameter of 6 mm and a length of 40 mm.

The magnet roller obtained in the above-mentioned manner was subjected to demagnetizing treatment by a well known method, followed by magnetizing treatment. Thus there was obtained a magnet roller which weighed 196.7 gram and had four poles in total including two S poles and two N poles. The average magnetic force of the four poles was 700 Gauss. Subsequently, the resultant magnet roller was cut off perpendicularly to the center shaft, and the cross section was observed by means of a stereomicroscope. As a result, voids were substantially not recognized in the vicinity of the outside periphery of the magnet main body portion, but were recognized on the periphery of the hollow portion which had a total volume of 16.1% based on the volume of the magnet main body portion.

Comparative Example 1

The procedure in Example 1 was repeated to produce an integrated shaft type magnet roller and further to carry out demagnetizing treatment, followed by magnetizing treatment except that a member for forming hollow portions was not placed in the cavity of a mold.

Thus, there was obtained a magnet roller which weighed 244 gram and had four poles in total having an average magnetic force of 700 Gauss. The resultant magnet roller was cut off perpendicularly to the center shaft, and the cross section was observed by means of a stereomicroscope. As a result, voids were recognized in the vicinity of the outside periphery of the magnet main body portion.

What is claimed is:

1. A magnet roller comprising:

a magnet main body portion made of a composition comprising a binder and a magnetic powder, and a shaft portion which is disposed at each lengthwise end of the magnet main body portion coaxially with an axis of the magnet roller, wherein the magnet main body portion is provided with at least one hollow portion which extends from one of the lengthwise ends to the other through the magnet main body portion along and around the axis so as to allow both the ends of the hollow portion to be open to surrounding atmosphere.

2. The magnet roller according to claim 1, wherein voids are substantially absent in the vicinity of the outside periphery of the magnet main body portion, but are present on the periphery of the hollow portion.

3. The magnet roller according to claim 1, wherein the magnet main body portion is formed by molding the composition with the use of a mold which has generated a magnetic field on the circumference of a cavity of said mold.

4. The magnet roller according to claim 1, wherein the composition comprises a resin and/or a rubbery elastomer as a binder and magnetic powders that are dispersed therein.

5. A process for producing a magnet roller as defined in claim 1, which comprises arranging in advance, at least one member for forming a hollow portion in a cavity of a mold which has generated a magnetic field on the circumference of said cavity, pouring a composition comprising a binder and a magnetic powder into said mold, and thereafter withdrawing said member for forming said hollow portion so that at least one hollow portion is formed in the inside of said magnet roller.

6. The process for producing a magnet roller according to claim 5, wherein a heat conductive material is used as the member for forming a hollow portion, the temperature of said member is kept higher than the temperature of the wall surface of the mold, and the composition is poured into said mold.

7. A developing unit which comprises a developing roller constituted of a sleeve installed in a freely rotatable manner and a magnet roller installed inside said sleeve; preserves a magnetic developer on the surface of said sleeve by the magnetic characteristics of said magnet roller; forms a thin layer having a prescribed thickness from said magnetic developer by means of a layer forming blade; allows the magnet roller to contact or approach the surface of an image forming body in the above-mentioned state so as to feed said magnetic developer from the sleeve to the surface of the image forming body by the magnetic characteristics of said magnet roller; and thus forms a visible image on the surface of said image forming body, characterized in that the magnet roller in claim 1, is brought into use.

8. The magnet roller according to claim 1, comprising:

a plurality of said hollow portions provided in said magnet main body portion.

9. A magnet roller comprising:

a magnet main body portion made of a composition comprising a binder and a magnetic powder, and a shaft portion which is disposed at each lengthwise end of the magnet main body portion coaxially with an axis of the magnet roller, wherein the magnet main body portion is provided with at least one hollow portion, disposed offset from said shaft portion and which extends from one of the lengthwise ends to the other through the magnet main body portion.

10. The magnet roller according to claim 9, comprising:

a plurality of said hollow portions provided in said magnet main body portion.

11. The magnet roller according to claim 9, comprising:

said hollow portions having ends open to surrounding atmosphere.

* * * * *